US010584501B2

(12) United States Patent
Rosati et al.

(10) Patent No.: US 10,584,501 B2
(45) Date of Patent: Mar. 10, 2020

(54) FORMWORK PANEL ASSEMBLY WITH RELEASABLE CONNECTING MEMBER AND METHOD OF REMOVING THE FORMWORK

(71) Applicant: Form 700 Pty Ltd, Altona (AU)

(72) Inventors: Emilio Rosati, Altona (AU); Wasyl Rosati, Altona (AU)

(73) Assignee: Form 700 Pty Ltd, Altona (AU)

( * ) Notice: Subject to any disclaimer, the term of this patent is extended or adjusted under 35 U.S.C. 154(b) by 0 days.

(21) Appl. No.: 15/764,313

(22) PCT Filed: Sep. 30, 2015

(86) PCT No.: PCT/AU2015/000594
§ 371 (c)(1),
(2) Date: Mar. 28, 2018

(87) PCT Pub. No.: WO2017/054028
PCT Pub. Date: Apr. 6, 2017

(65) Prior Publication Data
US 2018/0266126 A1 Sep. 20, 2018

(51) Int. Cl.
*E04G 11/08* (2006.01)
*E04G 19/00* (2006.01)
*E04G 9/02* (2006.01)

(52) U.S. Cl.
CPC ..... *E04G 11/087* (2013.01); *E04G 19/00* (2013.01); *E04G 19/003* (2013.01); *E04G 2009/023* (2013.01); *E04G 2009/028* (2013.01)

(58) Field of Classification Search
CPC ..... E04G 11/087; E04G 19/00; E04G 19/003
(Continued)

(56) References Cited

U.S. PATENT DOCUMENTS 954,636 A * 4/1910 Kurman ..... E04G 17/0714 249/193
1,236,852 A * 8/1917 McKay ..... E04G 11/18 249/193
(Continued)

FOREIGN PATENT DOCUMENTS

DE 1052664 B * 3/1959 ..... E04G 17/042
DE 2424945 A1 * 12/1975 ..... E04G 11/087
(Continued)

OTHER PUBLICATIONS

International Search Report and Written Opinion dated Nov. 20, 2015, issued in corresponding International Application No. PCT/AU2015/000594, filed Sep. 30, 2015, 8 pages.

*Primary Examiner* — Michael Safavi
(74) *Attorney, Agent, or Firm* — Christensen O'Connor Johnson Kindness PLLC

(57) ABSTRACT

This disclosure relates to a formwork panel assembly to mold upwardly extending building features such as columns or walls, that extend between adjacent floor slabs. In one aspect, the formwork panel assembly comprises at least two surface forming elements, and at least one connecting element adapted for removable location between the two surface forming elements, where adjacent edges of the surface forming elements abut against the connecting element so that the resulting formwork assembly forms a single, continuous casting surface, and wherein in use, the or each connecting element is separately releasable from the formwork assembly once a concrete surface has been formed.

10 Claims, 6 Drawing Sheets

(58) Field of Classification Search
USPC ..... 249/191, 44, 47, 192, 193, 194
See application file for complete search history.

(56) References Cited

U.S. PATENT DOCUMENTS 1,292,986 A * 2/1919 Ambursen ..... E04G 11/46 249/102
1,293,036 A * 2/1919 Church ..... E04G 11/46 249/189
1,313,393 A * 8/1919 Larzelere ..... E04G 11/02 249/193
1,546,586 A * 7/1925 Johnsen ..... E04G 11/54 249/193
1,658,681 A * 2/1928 Jordan ..... E04G 11/12 249/193
2,046,123 A * 6/1936 Jennings ..... E04G 11/062 249/191
2,989,794 A 6/1961 Bittner
4,211,385 A * 7/1980 Johanson ..... E04G 9/04 249/192
4,811,927 A * 3/1989 Slonimsky ..... E04G 9/02 249/191
5,552,103 A * 9/1996 Lee ..... E04G 11/087 249/193
5,625,989 A 5/1997 Brubaker et al.
5,827,442 A * 10/1998 Wicker ..... E04G 11/087 249/193
5,855,807 A * 1/1999 Hsieh ..... E04G 11/12 249/193
5,965,053 A * 10/1999 Carlson ..... E04G 17/002 249/191
6,024,339 A * 2/2000 Gates ..... E04G 11/14 249/191
8,011,637 B2 * 9/2011 Trimmer ..... E04G 17/0652 249/191
2002/0121586 A1 * 9/2002 Gates ..... E04G 11/14 249/45

FOREIGN PATENT DOCUMENTS

DE 3517304 A1 * 11/1986 ..... E04G 11/087
DE 3806012 A1 * 9/1989 ..... E04G 17/042
DE 3838509 C1 * 12/1989 ..... E04G 17/042
EP 0480092 A1 * 4/1992 ..... E04G 11/087
EP 1995394 A2 * 11/2008 ..... E04G 11/087
GB 638910 A 6/1950
GB 741765 A * 12/1955 ..... E04G 17/042
GB 2078841 A * 1/1982 ..... E04G 9/02

* cited by examiner 11
52
21
24
50
16
17
18
19
15
20
14
17a

FORMWORK PANEL ASSEMBLY WITH RELEASABLE CONNECTING MEMBER AND METHOD OF REMOVING THE FORMWORK

TECHNICAL FIELD

This invention relates to a formwork panel assembly. In a particular form the present invention relates to formwork that can be used to mold upwardly extending building features such as columns or walls that extend between adjacent floor slabs.

BACKGROUND

Construction of multi-story concrete buildings involves sequential floor by floor casting of concrete structures. In order to cast building components such as floor slabs, columns and other features, a casting structure referred to as formwork is used to progressively advance the building upwardly, floor by floor.

This generally involves using a lower floor slab as a support platform for formwork to cast the next floor slab above. In order to support an upper floor slab, upwardly extending building features such as columns and internal walls are also cast to support the upper floor slab once the formwork is removed.

Formwork to create a floor slab will comprise horizontal elements that are positioned between vertical building features such as columns and walls that extend between floor slabs. Reinforced concrete uses reinforcing steel in the form of steel rods, steel frames and mesh, which is positioned on and within formwork prior to pouring of concrete. In the case of vertical building features, the reinforcing framework must extend above and clear of the concrete, so that it is in turn, exposed to allow attachment of further upwardly extending reinforcement formwork. This allows extension of reinforcement frames for the progressive casting of vertical features such as columns or walls.

Only once the lower floor slab is formed, can the formwork for the vertical feature be put in place around the reinforcing steel frame work, ready for casting of the vertical feature above the new floor level.

This causes a delay in setting up the formwork required for the next floor slab. It is necessary for the concrete within the columns or other vertical features to set prior to removal of the formwork, which then enables the formwork for the next floor slab to be put in place. Obviously, the formwork for the next floor slab needs to abut against the vertical features so as to incorporate them in the upwardly extending building structure.

Current column or wall formwork cannot be used concurrently with formwork for creating the next floor slab, as the formwork around the vertical feature could not be removed. Obviously, it will need to extend from the floor surface of the lower slab to the underside surface of the upper floor slab and therefore would be wedged in place between these two concrete surfaces. The formwork would need to be destroyed or broken to be removed.

It is against this background and the problems and difficulties associated therewith that the present invention has been developed.

Certain objects and advantages of the present invention will become apparent from the following description, taken in connection with the accompanying drawings, wherein, by way of illustration and example, an embodiment of the present invention is disclosed.

SUMMARY

According to a first aspect, there is provided a formwork assembly for moulding an upwardly extending building feature comprising at least two surface forming elements for forming one side of said building feature, and at least one connecting element for location between the two surface forming elements, where adjacent edges of the surface forming elements abut against the connecting element so that the resulting formwork assembly forms a single, continuous casting surface.

In accordance with this aspect of the invention, the or each connecting element is separately releasable from the formwork assembly once a concrete surface has been formed. The resultant space between the adjacent surface forming elements created by removal of the connecting element provides sufficient access or clearance to prise the surface forming elements away from the hardened concrete surface. This thereby allows removal of the whole assembly once the concrete is set.

As will be appreciated in the above description, in use, a formwork assembly can extend from an upper surface of a lower floor slab to an underside surface of a floor slab above. This formwork assembly will be held captive between these surfaces until the connecting elements are removed. Once one or more of the connecting elements are removed, sufficient clearance will be provided to subsequently allow removal of the remaining surface forming elements from the newly formed concrete surface.

The invention is particularly suited to the formation of elongate internal walls, where the horizontal length of each individual surface forming element would otherwise make it difficult to remove the formwork unless it comprises the assembly which is subject of this disclosure.

In one form, each of the surface forming elements comprises a rectilinear frame secured to one side of a planar board member, with the other side of the planar board member being used as the concrete casting surface.

In one form, each surface forming element further comprises a border extending about a perimeter of the board so as to form the continuous casting surface along with the board, the border extending beyond at least one edge of the frame to form a flange.

In one form, the border extends beyond a pair of opposing edges of the frame to form a pair of flanges.

In one form, the border is made of a more wear resistant material than the board.

In one form, the border is made from a metal, and the board is made from one of a timber, a plywood, a plastic or a composite.

In one form, the or each connecting element comprises a cap for location between the flanges of adjacent surface forming elements, and a body shaped to substantially fill the void behind the flanges and between the frames.

In one form, the or each connecting element is an elongate element comprising a cross-sectional shape which is substantially constant throughout its length.

In one form, the or each connecting element is formed by extrusion. In an alternative, the or each connecting element is foamed by fabrication.

In one form, a resultant space between the adjacent surface forming elements created by removal of a connecting element, provides sufficient access or clearance to prise the surface forming elements away from a hardened concrete surface.

The or each connecting element comprises an elongate bar element that locates between surface forming elements so that edges of the surface forming elements abut against the connecting element. The width of the flange or extent of overhang is such that the flanges do not meet but instead there is a gap or space between the adjacent flange edges. In this case, the connecting element has an elongate projection along one edge that fills that gap, to in turn form a continuous planar casting surface.

In one form, dowels or bolts extend through aligned holes in the adjacent frame members and the connecting element to secure the two surface forming elements with respect to the connecting element.

In one form, the frame for the or each surface forming element comprises a plurality of perimeter frame members, and a portion of the border depends from each perimeter frame member.

In one form, each perimeter frame member and its respective portion of the border are secured together. In one form, these are secured together by welding, or by using fasteners or adhesive.

In one form, in an alternative, each perimeter frame member and its respective portion of the border are extruded together.

The formwork assemblies may further comprise three or more surface forming elements with a connecting element locating between abutting edges of each pair of adjacent surface forming elements. In this way, for a given area to be formed, a number of surface forming elements can be used which in turn reduces the size and weight of each surface forming element. This greatly assists in easier manual handling of the various elements forming the assembly.

The height of each surface forming element will be determined by the number of panels used and the distance between the upper surface of the lower floor and the underneath surface of the upper floor being formed. The length of the surface forming elements will depend on the type of vertical feature being created. For example, columns will require shorter lengths by comparison to internal walls which will require longer lengths.

An internal wall may be formed by using a pair of formwork panel assemblies spaced apart by the required thickness of the wall. Additional formwork can be placed so as to extend between the pair of formwork assembly panels at each end and held in place to form the ends of the walls. Ties can extend between the pair of formwork assembly panels to hold them together under the weight of the concrete, and the formwork forming the ends of the walls can be braced with respect to the pair of formwork panel assemblies.

In the case of forming a column, the formwork assembly panels can be connected along abutting edges and ties can extend between opposing pairs of formwork panel assemblies. Alternatively, a bracing frame can be formed around the assembled formwork panels to hold them in position.

According to a further aspect, there is provided a method for moulding an upwardly extending building feature using a formwork assembly, where the formwork assembly comprises at least two surface forming elements for forming one side of said building feature, and at least one connecting element adapted for removable location between the two surface forming elements, where adjacent edges of the surface forming elements abut against the connecting element so that the resulting formwork assembly forms a single, continuous casting surface, the method comprising the steps of moulding the upwardly extending building feature using the formwork assembly, and then, when the concrete has cured sufficiently, removing the or each connecting element to create one or more spaces between adjacent surface forming elements, where the or each space provides sufficient access or clearance to prise the surface forming elements away from the concrete surface.

A detailed description of one or more embodiments of the invention is provided below along with accompanying figures that illustrate by way of example the principles of the invention. While the invention is described in connection with such embodiments, it should be understood that the invention is not limited to any embodiment. On the contrary, the scope of the invention is limited only by the appended claims and the invention encompasses numerous alternatives, modifications and equivalents. For the purpose of example, numerous specific details are set forth in the following description in order to provide a thorough understanding of the present invention.

The present invention may be practiced according to the claims without some or all of these specific details. For the purpose of clarity, technical material that is known in the technical fields related to the invention has not been described in detail so that the present invention is not unnecessarily obscured.

BRIEF DESCRIPTION OF DRAWINGS

Embodiments of the present invention will be discussed with reference to the accompanying drawings wherein:

FIG. 1*b* is a detail view taken from FIG. 1*a;*

In the following description, like reference characters designate like or corresponding parts throughout the figures.

DESCRIPTION OF EMBODIMENTS

Figure 1:
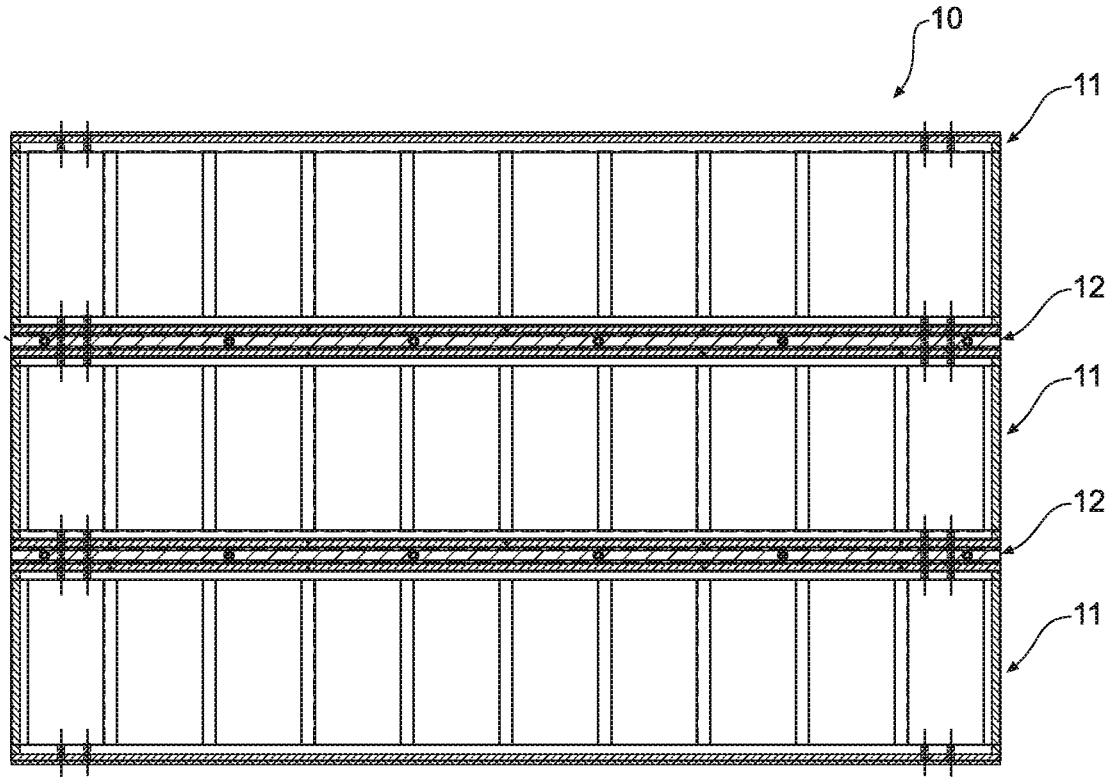
FIG. 1 illustrates a formwork panel assembly according to a first embodiment.
Figure 1A:
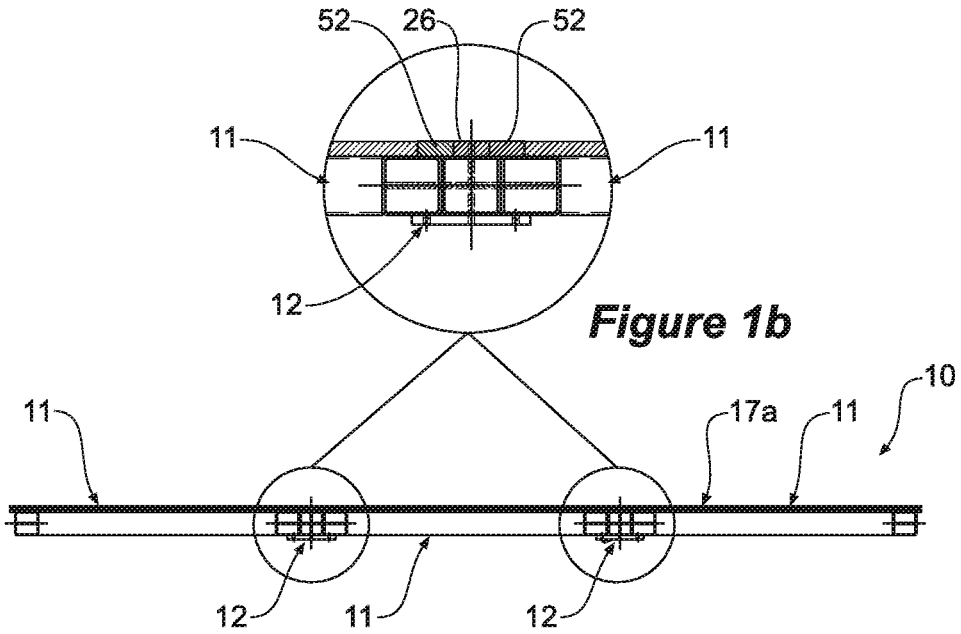
FIG. 1*a* is an end view of the formwork panel assembly of FIG. 1.

FIG. 1 illustrates a formwork panel assembly 10 according to an embodiment. The formwork panel assembly 10 comprises three surface forming elements 11, and two connecting elements 12, although more or less of each of the formwork panel assemblies 10, and surface forming elements 11 may be used as required. The connecting elements 12 are located between a pair of adjacent edges of surface forming elements 11. As can be seen in FIG. 1*a*, the formwork panel assembly 10 comprises a planar surface 17*a* against which concrete can be moulded.

Figures 2, 2A, 2B, 2C:
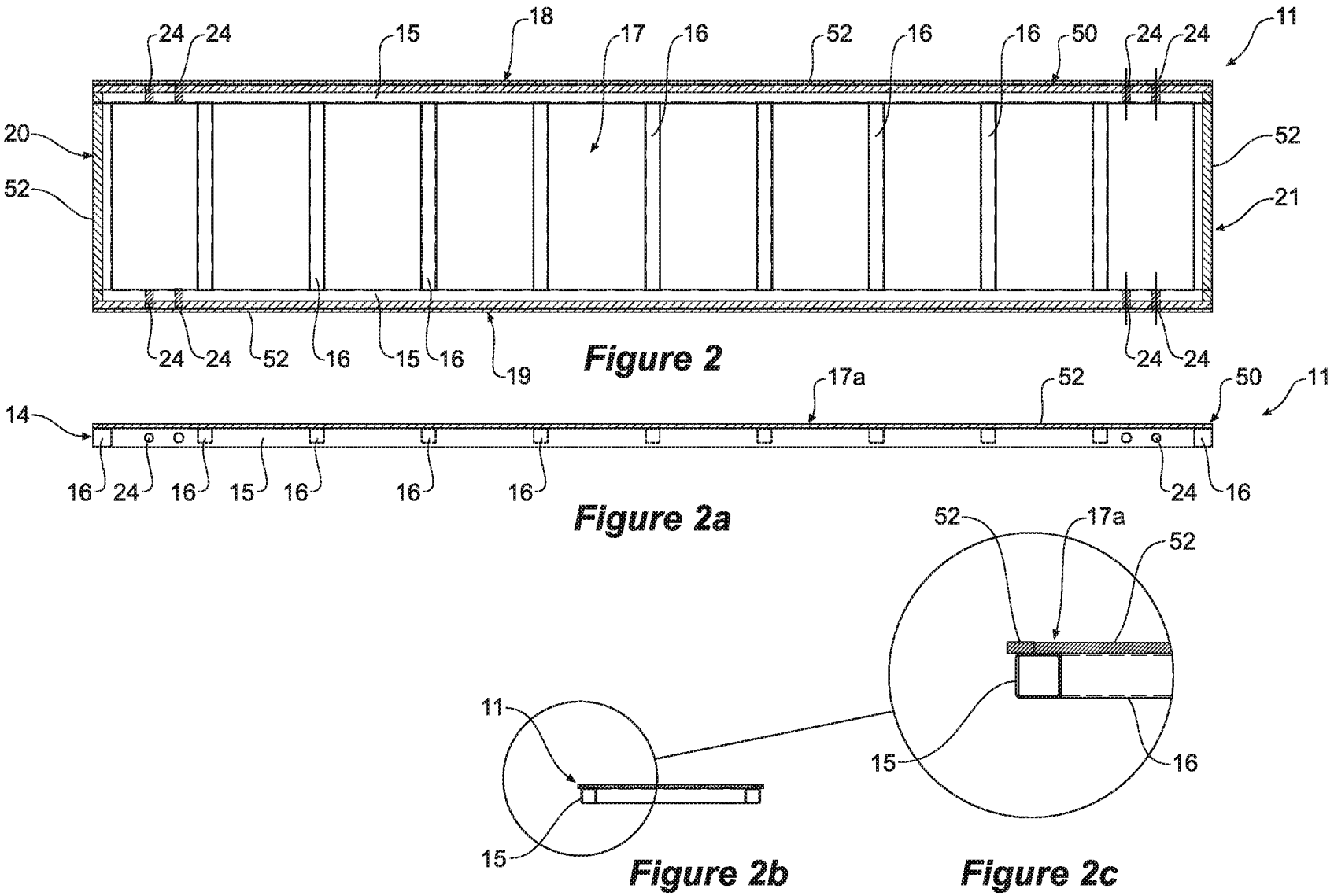
FIG. 2 illustrates a surface forming element from the formwork panel assembly of FIG. 1.
FIG. 2*a* is a side view of the surface forming element of FIG. 2.
FIG. 2*b* is an end view of the surface forming element of FIG. 2.
FIG. 2*c* is detail view taken from FIG. 2*b;*

Referring now to FIGS. 2 through 2*c*, where there is illustrated one of the surface forming elements 11 from the formwork panel assembly 10. The surface forming element 11 comprises a frame 14 constructed from steel tubes of square cross-sectional shape. Each frame 14 comprises a pair of horizontal members 15 and a number of vertical members 16 welded at each end between the horizontal members 15.

The frame 14 is generally rectangular in shape and has attached to it a board 17. In this embodiment, the board 17 is made of a material such as plywood, having a thickness of approximately 12 millimetres, which forms part of the planar surface 17*a*.

The frame 14 further comprises a border 50 extending about a perimeter of the board 17. This border 50 is comprised of a plurality of flat strips 52 of a material (being namely flat steel bar welded to the frame 14 in this embodiment) of a matching thickness to the board 17, but more wear resistant than the material of the board 17, where one strip 52 extends along each of the horizontal members 15, and the vertical members 16 which define the ends 20 and 21 of the frame 14. With reference to FIG. 2*c*, it can be seen that the border 50 extends past the edge of the frame 14 by approximately 10 millimetres along the upper and lower edges 18 and 19. In contrast, the border 50 is flush with the ends 20 and 21 of the frame 14.

The horizontal members 15 of the frame 14 comprise pairs of apertures 24 for the location of retaining dowels, as will be explained in further detail below.

Figure 3A:
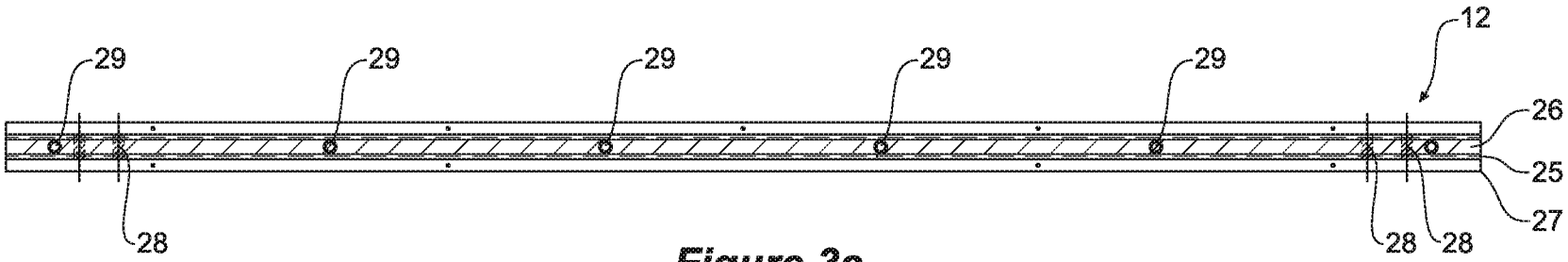
FIG. 3*a* is plan view of the connecting element of FIG. 3.
Figure 3B:
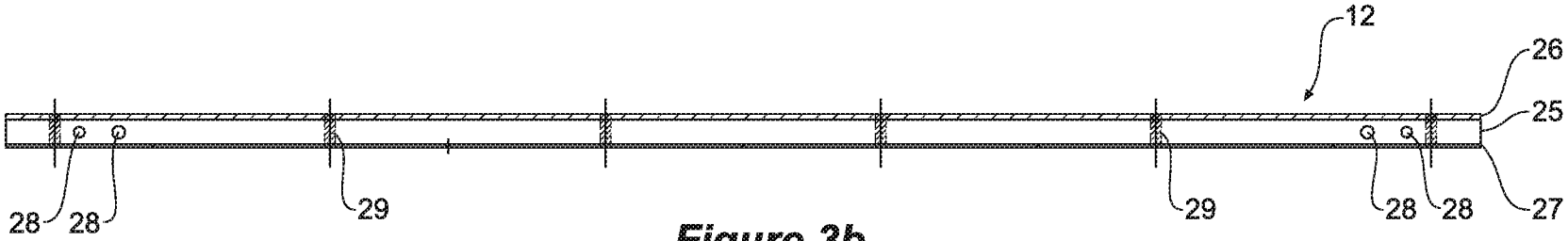
FIG. 3*b* is a side view of the connecting element of FIG. 3.
Figure 3:
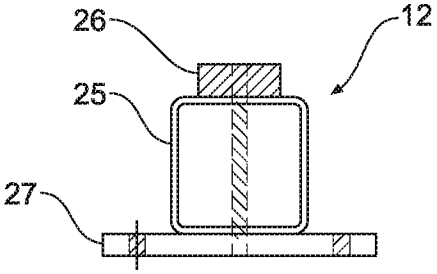
FIG. 3 illustrates a connecting element from the formwork panel assembly of FIG. 1.

FIG. 3 shows a connecting element 12 from the formwork panel assembly 10, which, in this embodiment, comprises a length of square steel tubing 25, being 50 mm square, and having attached to it on one side a cap 26 comprising an elongate length of steel strip being 12 millimetres thick and approximately 30 millimetres wide. This leaves a clearance of approximately 10 millimetres on either side of the cap 26, being from the edge of the cap 26 to the edge of the steel tubing 25.

On the other side of the steel tubing 25, there is a cover plate 27 having a thickness of 6 millimetres but a width of 100 millimetres.

The square steel tubing 25 has a number of apertures along its length. Firstly, it has a pair of apertures 28 at either end. At 90 degrees to the apertures 28, there are a number of apertures 29 spaced along the steel tube 25 that extend through each of the square steel tubing 25 and the cap and cover plate 26, 27.

As can be seen from FIG. 1, in use, the connecting elements 12 are placed between adjacent surface forming elements 11. Each of the upper and lower edges 18 and 19 of the surface forming elements 11 abuts against the square steel tubing 25 of the connecting element 12, with the edges of the border 50 on the surface forming element 11 abutting against either side of the cap 26. With reference to FIGS. 1*a* and 1*b*, it can be seen that the edges of the border 50 therefore overlap (by ten millimetres) the square steel tubing 25.

Being made of a harder, more wear resistant material than that of the board 17, means that the border 50, which extends beyond the edges of the frame 14, is less susceptible to damage resulting from normal handling and positioning of surface forming elements 11, than would be the board 17 if this extended beyond the edge of the frame 14 in this fashion.

On the other side of the connecting element 12, the cover plate 27 extends over a portion of the horizontal member 15 of the upper and lower frame 14.

In this way, overlapping joints are formed that prevent egress of concrete while at the same time providing a smooth and flush moulding surface 17*a*, when the surface forming elements 11 and connecting elements 12 are assembled.

Figure 4:
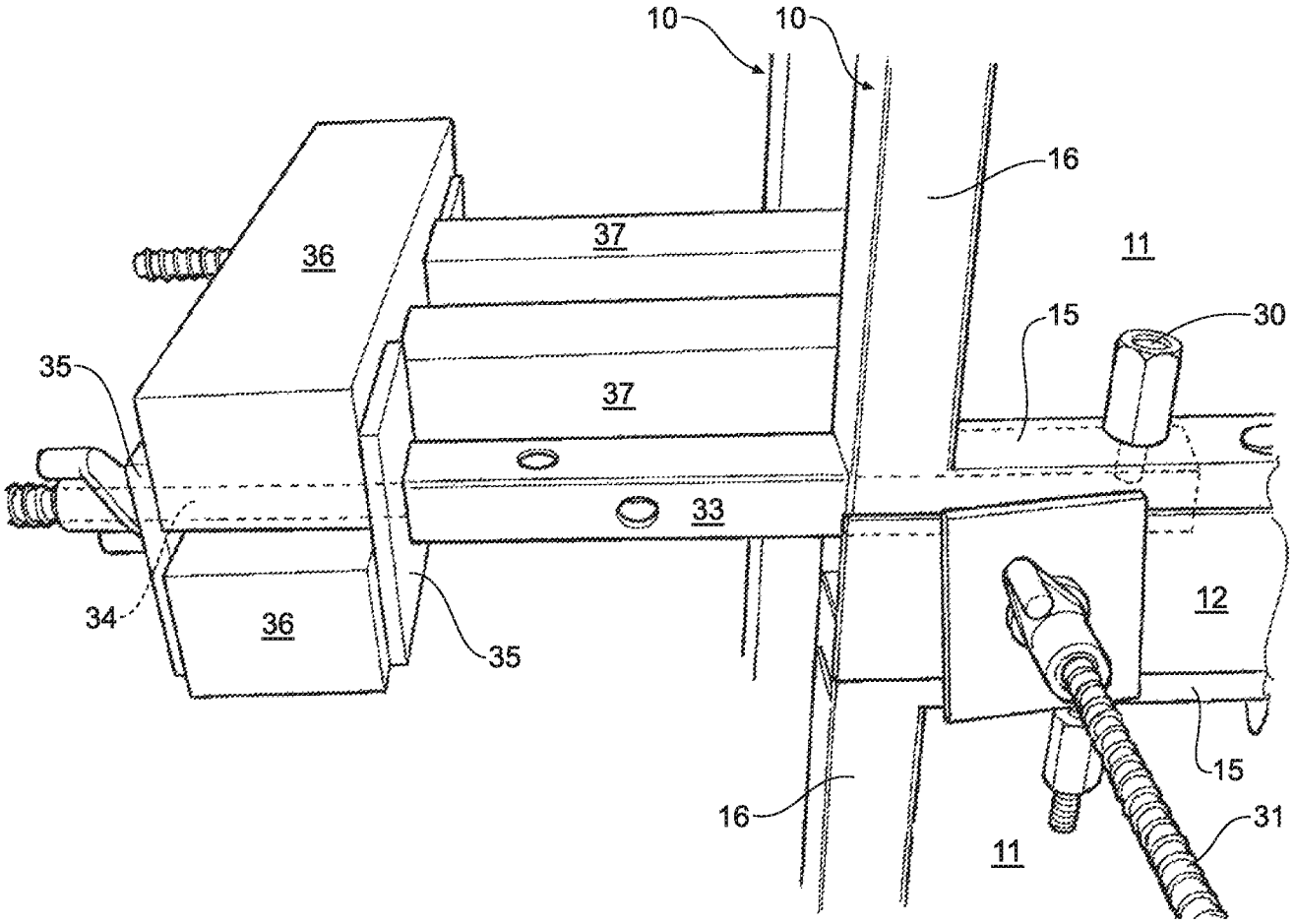
FIG. 4 illustrates a portion of an end section of a formwork panel assembly, showing connecting pins, panel ties and an end formwork bracing assembly.

As can be seen in FIG. 4, the pairs of apertures 24 in the horizontal member 15 of the frame 14 align with the pairs of apertures 28 in the connecting element 12. This enables dowels 30 to be inserted through both apertures 24 and 28 to secure an upper and a lower surface forming element 11 with respect to a connecting element 12. The dowels 30 may be threaded (such as by use of z-tie threads) to clamp the components together.

FIG. 4 also shows horizontal ties 31 that extend between adjacent formwork panel assemblies 10. The horizontal tie 31 locates in apertures 29. These horizontal ties also comprise z-tie rods, and resist the weight of the concrete pushing the adjacent formwork panel assemblies 10 apart. A number of horizontal ties 31 can be located in the apertures 29 along the length of the connecting element 12.

FIG. 4 also shows end braces which are used to hold formwork located between and opposite the opposed or adjacent formwork panel assemblies 10. As seen in FIG. 4, the formwork panel assemblies 10 are being used to create an elongate wall and therefore are only spaced apart by approximately 300 to 400 millimetres. Accordingly, formwork (not shown) can be placed between this gap at each end to form the end of the walls between the formwork panel assemblies 10. That formwork is held in place during pouring of the concrete by bracing bars 33.

The bracing bar 33 slides within the square steel tubing used to form the horizontal member 15 of a surface forming element 11. A bracing bar 33 has an aperture in one end through which the dowel 30 locates thereby holding the bracing bar 33 firmly with respect to the horizontal member 15.

At the other end of the bracing bar 33 there is a z-tie rod 34 secured to and extending out of the end of the bracing bar 33. Plates 35 are used to clamp cross bars 36 between adjacent bracing bars 33 that are connected to each of the surface forming elements 11. A pair of bracing bars 33 are used at the same level on adjacent surface forming elements 11. Therefore, the plates 35 can be used to clamp cross bars 36 between adjacent bracing bars 33. The plates 35 have apertures through which the z-tie rods 34 locate which then enable the cross bars 36 to be clamped with respect to the bracing bars 33. Braces 37 are then located between the cross bars 36 and a formwork that is located between the adjacent formwork panel assemblies 10. In this matter, a convenient way is provided to brace the end formwork extending between adjacent formwork panel assemblies 10, against outward movement.

It would also be possible to have apertures through the end vertical bars 16 on the surface forming elements 11. These apertures would both be normal with respect to the surface forming element 11 and parallel to it. This would enable adjacent edges to be abutted and secured using dowels 30. This process may be used in the case of forming columns where the length of the surface forming elements 11 are reasonably short and it is more convenient to join the formwork panel assemblies 10 at adjoining edges where a square or rectangular cross-section column is being manufactured.

As will be seen from the above description, the formwork panel assembly 10 can be easily assembled so as to put in place formwork which can mould vertical building features between floor slabs. Once the formwork panel assemblies 10 are in place, the formwork forming the underside surface of the upper floor can abut against the upper edge of the formwork panel assembly 10.

Of course, this would result in the formwork panel assembly 10 being wedged between the upper surface of the lower floor slab and the underside surface of the upper floor slab once the surrounding formwork forming the underside surface of the upper floor slab is removed. However, the connecting elements 12 can be easily removed from the formwork panel assembly 10 from the outside. This then provides access for levering off the individual surface forming elements 11 from the moulded concrete surface. It will be readily apparent that this invention provides a means of removing formwork which would otherwise be wedged between a lower and upper surface between floor slabs.

Referring now to FIGS. 5 through 7*a*, where there is illustrated a formwork panel assembly 100 according to a further embodiment. Those parts of the formwork panel assembly 100 which are identical (or near identical) to corresponding parts shown in the formwork panel assembly 10, will be denoted by the same reference numerals and will not be described again in detail.

Figure 5A:
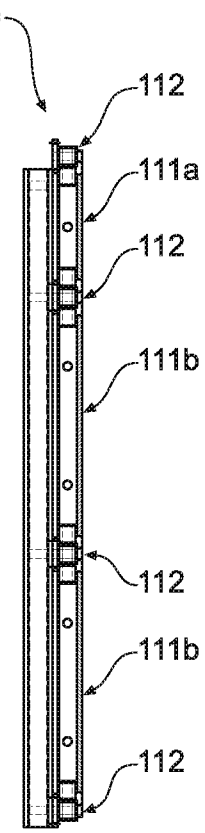
FIG. 5*a* is an end view of the formwork panel assembly of FIG. 5.
Figure 5:
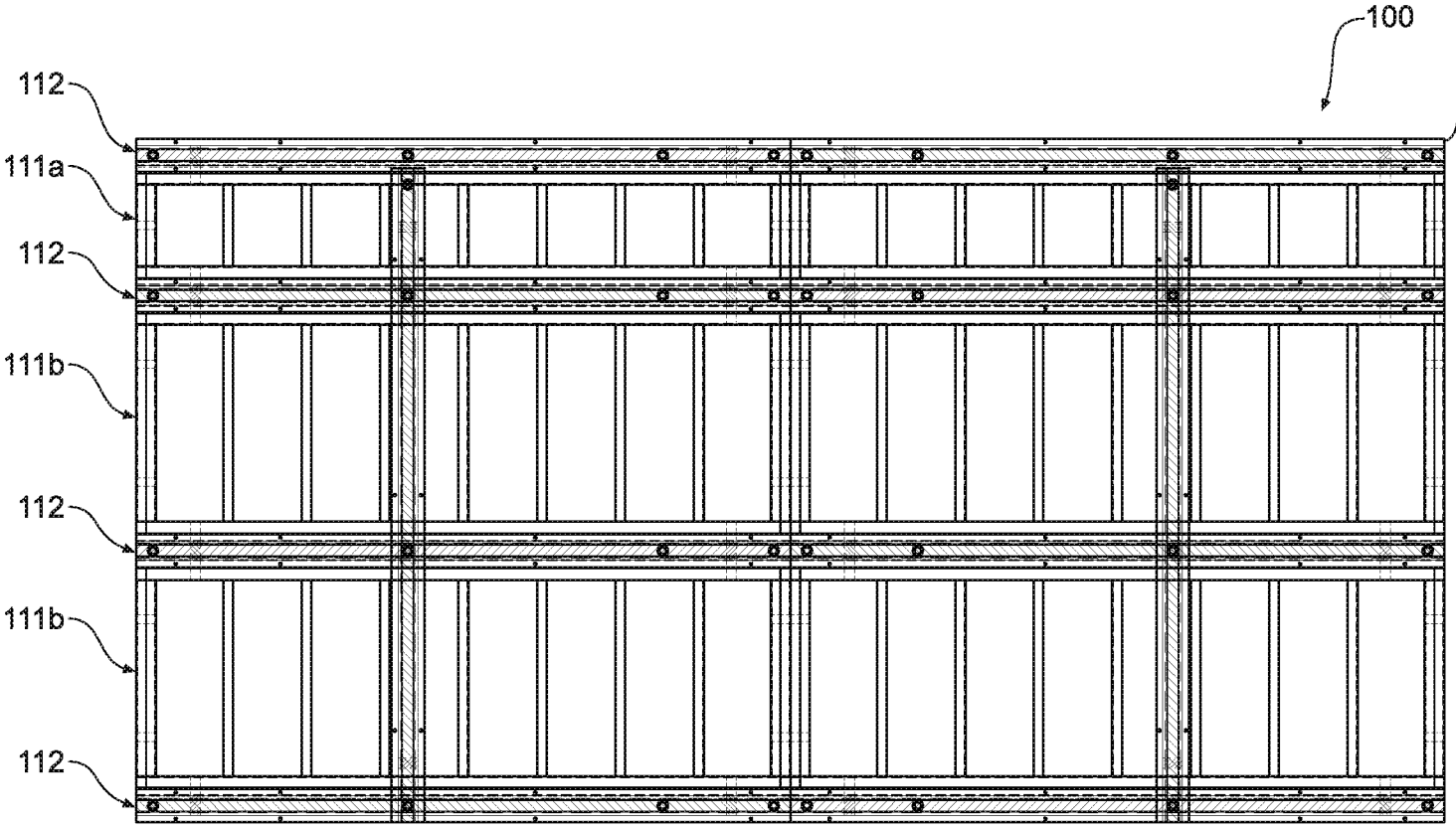
FIG. 5 illustrates a formwork panel assembly according to a second embodiment.
Figure 6:
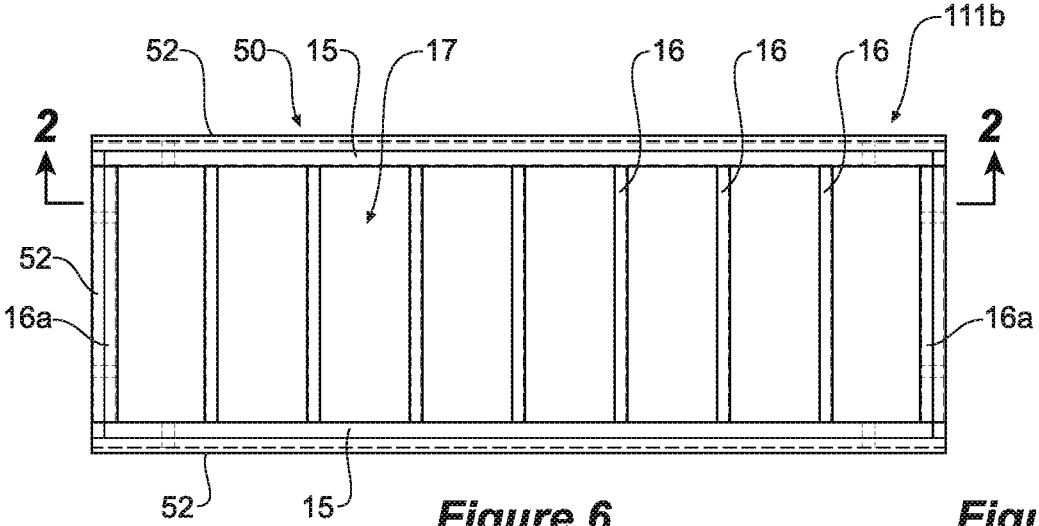
FIG. 6 is a plan view of a surface forming element from the formwork panel assembly of FIG. 5.
Figure 6B:
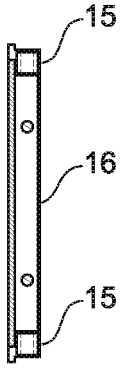
FIG. 6*b* is an end view of the formwork panel assembly of FIG. 6.
Figure 6A:
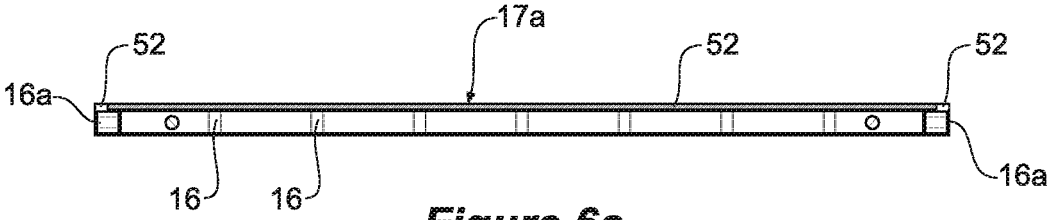
FIG. 6*a* is a side view of the surface forming element of FIG. 6.
Figure 7A:
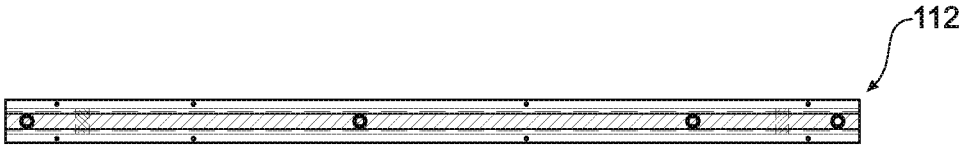
FIG. 7*a* is a plan view of the connecting element of FIG. 7.
Figure 7:
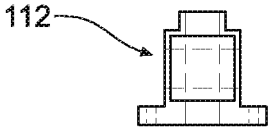
FIG. 7 is an end view of a connecting element from the formwork panel assembly of FIG. 5.
Figure 8:
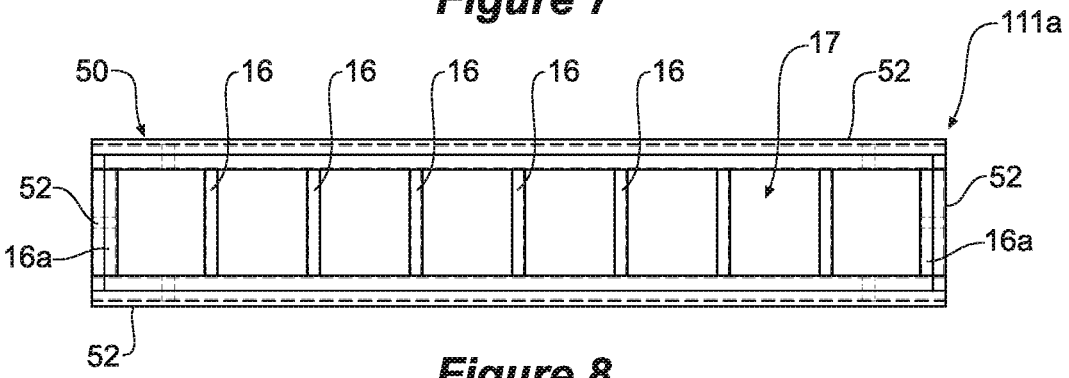
FIG. 8 is a plan view of a further surface forming element from the formwork panel assembly of FIG. 5.

The formwork panel assembly 100 comprises three surface forming elements 111 (of two sizes, namely IIIa and IIIb) and four connecting elements 112. The connecting elements 112 are located between a pair of adjacent edges of surface forming elements 111. As can be seen in FIG. 5*a*, the formwork panel assembly 100 comprises a planar surface 17*a* against which concrete can be moulded.

The surface forming elements 111 differ from those of the previous embodiment in that each comprises a frame 114 of square aluminium tubing (as opposed to square steel tubing). This aluminium tubing makes the surface forming elements 111 considerably lighter than those of the previous embodiment.

The frame for the or each surface forming element 111 comprises a plurality of perimeter frame members 15 and 16*a*, and a portion of the border 50 depends from each perimeter frame member 15 and 16*a*. In this embodiment, each perimeter frame member 15 and 16*a*, and its respective portion of the border 50, are extruded together (as opposed to fabricated).

Moreover, the connecting elements 112 differ from those of the previous embodiment in that each comprises a sectional shape similar to that of connection element 12, but which is extruded (as opposed to fabricated) from aluminium (as opposed to steel). This use of aluminium tubing makes the connecting elements 112 considerably lighter than those of the previous embodiment. Moreover, manufacture by extrusion is considerably less labour intensive, and therefore cheaper, than manufacture by fabrication.

Therefore, in one aspect of this invention, the invention allows formwork creating a vertical surface between floor slabs to be put in place currently with the upper slab formwork and for it to be removable once the concrete of the upper slab is set and cured.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

The reference to any prior art in this specification is not, and should not be taken as, an acknowledgement or any form of suggestion that such prior art forms part of the common general knowledge.

It will be appreciated by those skilled in the art that the invention is not restricted in its use to the particular application described. Neither is the present invention restricted in its preferred embodiment with regard to the particular elements and/or features described or depicted herein. It will be appreciated that the invention is not limited to the embodiment or embodiments disclosed, but is capable of numerous rearrangements, modifications and substitutions without departing from the scope of the invention as set forth and defined by the following claims.

The invention claimed is:

1. A formwork assembly for moulding an upwardly extending building feature, the formwork assembly comprising:

at least two surface forming elements for forming a side of said building feature; and a removable connecting element positioned between the two surface forming elements, wherein each forming element comprises a rectilinear frame, a planar board member and a border extending about a perimeter of the board and beyond a pair of opposing edges of the frame to form a pair of flanges, wherein the connecting element comprises a cap for location between the flanges of adjacent surface forming elements, a cover plate, and a body between the cap and the cover plate which is shaped to substantially fill the void behind the flanges and between the frames of the forming elements, and wherein in use, adjacent flanges of the surface forming elements abut against the cap of the connecting element such that the resulting formwork assembly forms a single, continuous casting surface, and the cover plate of the connecting element extends behind the two surface forming elements, and the connecting element is separately releasable from the formwork assembly once a concrete surface has been formed.

2. The formwork assembly of claim 1, wherein the connecting element is so sized and shaped as to create, via removal of the connecting element, a space between adjacent surface forming elements sufficient to provide access or clearance to pry the surface forming elements away from the concrete surface.

3. The formwork assembly of claim 2, wherein for each surface forming element the rectilinear frame is secured to one side of a planar board member, and wherein, in use, the other side of the planar board member forms at least a part of the continuous casting surface.

4. The formwork assembly of claim 1, wherein for each surface forming element the border forms the continuous casting surface along with the planar board member.

5. The formwork assembly of claim 4, wherein the border is made of a material with greater wear resistance than the material of the planar board member.

6. The formwork assembly of claim 1, wherein the connection element is an elongate element comprising a cross-sectional shape which is substantially constant throughout a length of the elongate element.

7. The formwork assembly of claim 6, wherein the connection element is formed by extrusion.

8. The formwork assembly of claim 1, further comprising at least one of dowels and bolts configured to extend through aligned holes in a pair of adjacent surface forming elements, and the cover plate of their respective connecting element, to secure the adjacent surface forming elements and the corresponding connecting element together.

9. A method for moulding an upwardly extending building feature using a formwork assembly comprising at least two surface forming elements for forming a side of said building feature, and a removable connecting element positioned between the two surface forming elements, wherein each forming element comprises a rectilinear frame, a planar board member and a border extending about a perimeter of the board and beyond a pair of opposing edges of the frame to form a pair of flanges, wherein the connecting element comprises a cap for location between the flanges of adjacent surface forming elements, a cover plate, and a body between the cap and the cover plate which is shaped to substantially fill the void behind the flanges and between the frames of the forming elements, and wherein in use adjacent flanges of the surface forming elements abut against the cap of the connecting element such that the resulting formwork assembly forms a single, continuous casting surface, the method comprising:

moulding the upwardly extending building feature using the formwork assembly; and then, when the concrete has cured sufficiently, removing the connecting element to create a space between adjacent surface forming elements, wherein the pace provides sufficient access to pry the surface forming elements away from the concrete surface.

10. The formwork assembly of claim 1, wherein the connecting element comprises a number of apertures extending through each of the cap, the body and the cover plate thereof, spaced apart along its length.

* * * * *